US005546857A

United States Patent [19]

Gerhardt et al.

[11] Patent Number: 5,546,857

[45] Date of Patent: Aug. 20, 1996

[54] STEEL BELT PRESS WITH INLET MOUTH CONTOUR ADJUSTABILITY

[75] Inventors: Klaus Gerhardt, Rheurdt; Lothar Sebastian, Bochum; Horst Weiss, Krefeld, all of Germany

[73] Assignee: G. Siempelkamp GmbH & Co., Krefeld, Germany

[21] Appl. No.: 531,035

[22] Filed: Sep. 20, 1995

[30] Foreign Application Priority Data

Sep. 21, 1994 [DE] Germany ..... 44 33 641.1

[51] Int. Cl.[6] ..... B30B 5/06

[52] U.S. Cl. ..... 100/93 P; 100/154; 156/583.5; 425/371

[58] Field of Search ..... 100/93 P, 93 RP, 100/151, 152, 154; 156/583.5; 425/371

[56] References Cited

U.S. PATENT DOCUMENTS

| | | | |
|---|---|---|---|
| 4,647,417 | 3/1987 | Böttger et al. | 156/583.5 |
| 4,718,843 | 1/1988 | Carlsson et al. | 100/93 RP |
| 4,850,846 | 7/1989 | Walter | 100/152 |
| 4,923,384 | 5/1990 | Gerhardt | 100/154 |
| 5,042,372 | 8/1991 | Bielfeldt et al. | 100/154 |
| 5,112,209 | 5/1992 | Ahrweiler et al. | 100/154 |
| 5,433,145 | 7/1995 | Bielfeldt | 100/154 |
| 5,454,304 | 10/1995 | Bielfeldt | 100/154 |

FOREIGN PATENT DOCUMENTS

| | | | |
|---|---|---|---|
| 3133792 | 3/1983 | Germany . | |
| 3825819 | 2/1990 | Germany . | |
| 3914107 | 10/1990 | Germany | 100/151 |

*Primary Examiner*—Stephen F. Gerrity
*Attorney, Agent, or Firm*—Herbert Dubno

[57] ABSTRACT

A continuous press for the production of pressed board comprises an inlet mouth of the steel belts, between which the comminuted material is pressed, which has its contour adjustable by imparting a bending moment to a cantilevered tongue of the respective press platen. The positions of the tongue are set by shifting a slider on the respective press beam to allow a step of a respective abutment staircase to engage a counter bar. The slide has a piston and cylinder setting drive.

6 Claims, 5 Drawing Sheets

STEEL BELT PRESS WITH INLET MOUTH CONTOUR ADJUSTABILITY

FIELD OF THE INVENTION

The present invention relates to relates to a continuous press for the pressing of mats of material into pressed board and, in particular, to continuous presses of the steel belt type which have adjustable contours of the inlet mouth of the press.

BACKGROUND OF THE INVENTION

In the pressing of mats of material to produce pressed board and especially the formation of pressed board from sawdust, wood chips and wood fibers or other woody materials, a mat of such comminuted materials, generally mixed with a binder, is fed into the converging mouth of a continuous press between a pair of steel belts and is hot pressed therein to consolidate the material into a board.

A typical press of this type can include upper and lower press members mounted in a press stand with the upper and lower press members each including a respective endless steel press belt which cooperates with an endless circulating roller device, the roller bars of which brace the respective steel belts against heated press platens or plates. The lower member can include a lower horizontal beam on which the heated lower press platen is mounted while the upper member of the press has an upper beam on which its heated press platen is arranged. The rollers are supported by the press platens and, in turn, brace the steel belts. In the press of German Patent 31 33 792, at the mouth of the press a projecting tongue of a press platen can have its contour set so that when a bending moment is imparted to it, a preset contour can be established. This is used to adjust the contour of the converging mouth at the inlet side of the press. The fixing of the inlet contour has been found to be significant since the contour defines the starting conditions of the pressing operation and, in large measure, influences the quality of the product which can be obtained.

In the system of German Patent 31 33 792, the means for fixing the inlet contour, i.e. the contour of the mouth, was a row of spaced apart abutments in one embodiment and a displaceable wedge in another. The row of stops or abutments could not be readily adjusted without substantial downtime of the press and, while the wedge allowed a certain measure of adjustability, the configuration could not be statically determined for all positions of the wedge nor could a variety of curvatures be established in a well defined manner as was desirable.

OBJECTS OF THE INVENTION

It is, therefore, the principal object of the present invention to provide an improved continuous press which overcomes the drawbacks outlined above and which, while overcoming these drawbacks, enables optimum setting of different inlet or mouth contours to enable different operating requirements to be established.

Another object of this invention is to provide a continuous press for the production of pressed boards which permits greater variability in the configuration of the mouth defined at the inlet side of the press while ensuring that the different configurations will be maintained with a high degree of precision.

Still another object of this invention is to provide an improved continuous press, especially for the production of pressed board, which overcomes the drawbacks of earlier presses.

SUMMARY OF THE INVENTION

These objects and others which will become apparent hereinafter are attained, in accordance with the invention by providing, in a press of the type described, a gap between the tongue of the or each press platen and the respective upper or lower beam and in this gap providing a slider, hereinafter referred to as an inlet contouring slider, shiftable toward the inlet and back by a contour setting drive. According to the invention, the slider is provided with a multiplicity of steps extending transverse to the direction of feed of the press and forming a contour-defining abutment "staircase" which is juxtaposed with at least one counter bar of the respective press platen tongue so that, by the adjustment of the position of the slider, the step of the staircase which engages the respective counter bar can be selected and the contour of the tongue defined upon the bending thereof.

More particularly, a continuous press for the production of pressed board from a mat of comminuted material can comprise:

- a press stand;
- upper and lower beams mounted in the stand;
- upper and lower heated press platens spaced apart between the upper and lower beams on the stand;
- upper and lower endless steel belts mounted on the stand, having passes traveling between the press platens and defining an inlet mouth at an inlet side of the press;
- respective endless bracing roller devices interposed between each of the passes and the respective press platen to brace the respective pass of the respective belt against the respective press platen;
- at least one cantilever tongue projecting on a respective one of the press platens toward the inlet side of the press and defining a gap with the respective one of the beams;
- means for setting a contour of the mouth and including means for imparting a bending moment to the tongue; and
- means for fixing a configuration of the tongue and including:
  - a contouring slider guided on the one of the beams,
  - a contouring drive operatively connected with the contouring slider for moving the contouring slider back and forth along the one of the beams,
  - a plurality of steps on the slider extending transverse to a direction of feed through the press and disposed in a stop-defining staircase, and
  - a counter bar selectively engageable by the steps in accordance with displacement of the slider, the counter bar being provided on the respective press platen and, by engagement with a selected step of the staircase, determining the configuration of the tongue.

Surprisingly, the use of the slider and step staircase enables defining of a plurality of bend lines for the tongue, depending upon the position of the slider, without the need for any significant downtime of the press for resetting the various steps and nevertheless ensures that the bend lines accurately fit desired contours depending upon the geometry of the steps and the bars. Adjustment is simple and quick and the aforedescribed drawbacks are thus completely obviated.

According to a feature of the invention, the inlet contour setting drive is a cylinder and piston arrangement.

According to another feature of the invention, moreover, at the inlet side of the tongue, a lever member is provided which is rigidly connected to the tongue so that, when that lever member is pivotally displaced, the bending moment is imparted to the tongue to bring the respective step or steps into engagement with corresponding counter bars.

The lever member can be connected to the respective press beam by a link having horizontal pivot axes. It has been found to be advantageous to provide at the inlet side of the press an aligning device or orienting device for the roll bodies of the bracing device. The inlet tongue and slider can extend into the region of this aligning device. It has been found to be advantageous, moreover, to provide both the upper press member and the lower press member with such a tongue, bending unit and contour fixing unit. The structural symmetry leads to a symmetry in the application of pressure and improved quality of the product.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
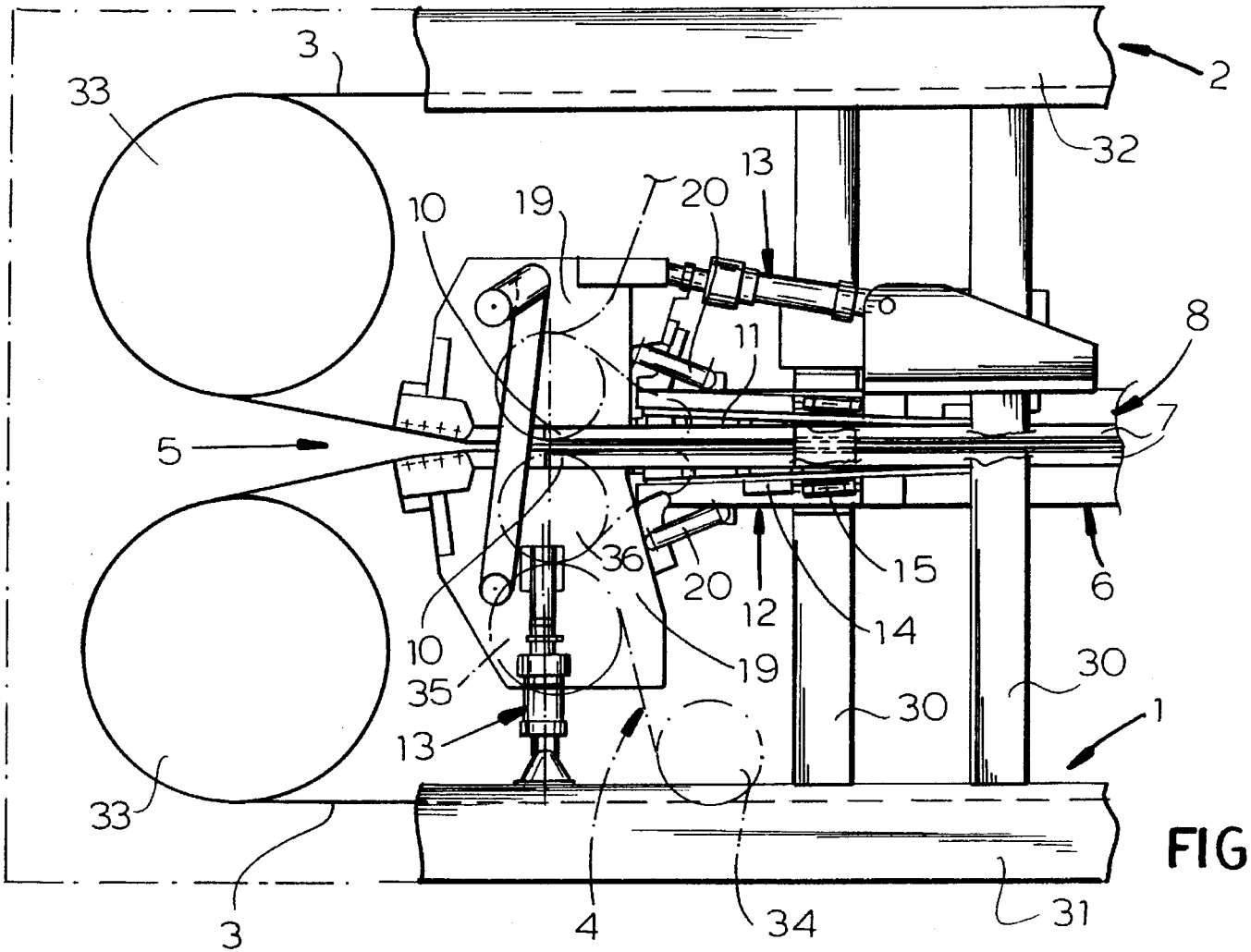
FIG. 1 is a side elevational view of the intake mouth of a continuous press according to the invention.

The continuous press shown in the drawing serves in the pressing of mats of material to be formed into pressed board and particularly, chipboard, fiberboard and other boards of wood or wood materials. In general, such mats consist of a comminuted substance, e.g. wood, and a binder which, in the case of wood particles or fibers, is customarily a synthetic resin thermosetting binder such as a phenol-formaldehyde resin or a resorcinol resin. However, the invention is also applicable to binders which set by hydration, e.g. so-called hydration binders, which can utilize preferably wood particles but also fibers and particles derived from other sources.

The press basically comprises a lower part 1 and an upper part 2, the latter being supported on uprights 30 in the form of frames which lie in vertical planes (FIG. 1) perpendicular to a base 31 and carry an upper beam 32 from which the members of the upper part 2 may be suspended. Respective endless steel press belts 3 are guided between the upper and lower members 1 and 2 on rollers or drums 33 which may be mounted on the upper and lower members of the press in a conventional manner. The press may also be formed with continuously moving support or bracing means for these belts, represented generally at 4 and in the form of a bracing belt or chain of rollers guided over or around rollers 34, 35 and 36 by way of example.

The belts and their continuous bracing chains or members are oriented to define a mouth 5 of the press which converges in a direction of feed of the mats to be pressed into the press, i.e. converges in the direction of travel of the belts 3 in juxtaposition with one another.

The lower press part 1 has a lower beam 6 with a heated press platen 7 while the upper press part 2 has a beam 8 also provided with a heated press platen 7. The belts 3 are braced against a heated press platen 7 via the thermally conductive rollers 9 forming the roller chain previously described, the rollers being visible in FIG. 2 and 3 (see German Patent 3,825,819).

The mouth 5 is formed in part by tongues 10 which project from the press beams 6, 8 toward the inlet side of the press and define between them a gap 11 within which the material of the mates is compressed. Means 12 is provided for establishing the inlet contour of the mouth 5. A device 13 is provided in addition for adjustment of the inlet tongues 10 by creating a bending moment therein. In the embodiment shown each of the lower portion 1 of the press and the upper portion 2 thereof has such an inlet tongue 10. As has been indicated, the press has a device 12 for setting the inlet contour as reference to FIGS. 2, 4 and 5 will show. The inlet contour is defined as the curvature of the inlet mouth as it converges toward the interior of the press.

The device 12 comprises a contour slider 14 guided on the respective inlet tongue 10 of the press beam 6 or 8 and adjustable in the inlet direction and back by an inlet contour positioning drive. This positioning is signified by the double headed arrow.

The contour slider 14 is comprised of a plurality of steps 16 running transversely to the inlet feed direction and which are associated in a contour defining stepped body 17. The step body 17 is juxtaposed with at least one counter bar connected with the inlet tongue 10. With the aid of the device 13 for adjusting the inlet tongue 10, the bar 18 is shifted to engage one of the steps 16 of the body 17. In this manner and through the adjustment of the contour slider 14, deformation of the inlet tongue 10 can define the bending line on one side of the board to be formed. In the embodiment shown and in a preferred embodiment, the inlet contour setting drive 15 is a piston-and-cylinder arrangement.

On the inlet tongue 10 in the region of the mouth 5, a lever member 19 is mounted so that this member is substantially rigid with the respective tongue, i.e. is so fixed thereto that deflection of the lever member 19 will deform the inlet tongue 10. The device 13 for adjusting the inlet tongue 10 engages this lever member 19. The device 13 is also a piston-and-cylinder arrangement. Each lever member 19 is connected by a link 20 with the associated press beam 6 or 8. In particular, the link 20 has horizontal pivot axis 21 connecting it to the lever member 19 as well as to one of the press beams 6 or 8.

The continuous press of the invention also has an aligning device 22 for positioning the roller bracing unit 4 at the mouth. This aligning device 22 is designed to prevent canting of the steel belts 3 or the bracing chain 4 or to correct for such canting. In this case, the inlet tongue 10 and the contour slider 14 can project into the region of the aligning device 22.

Figure 2:
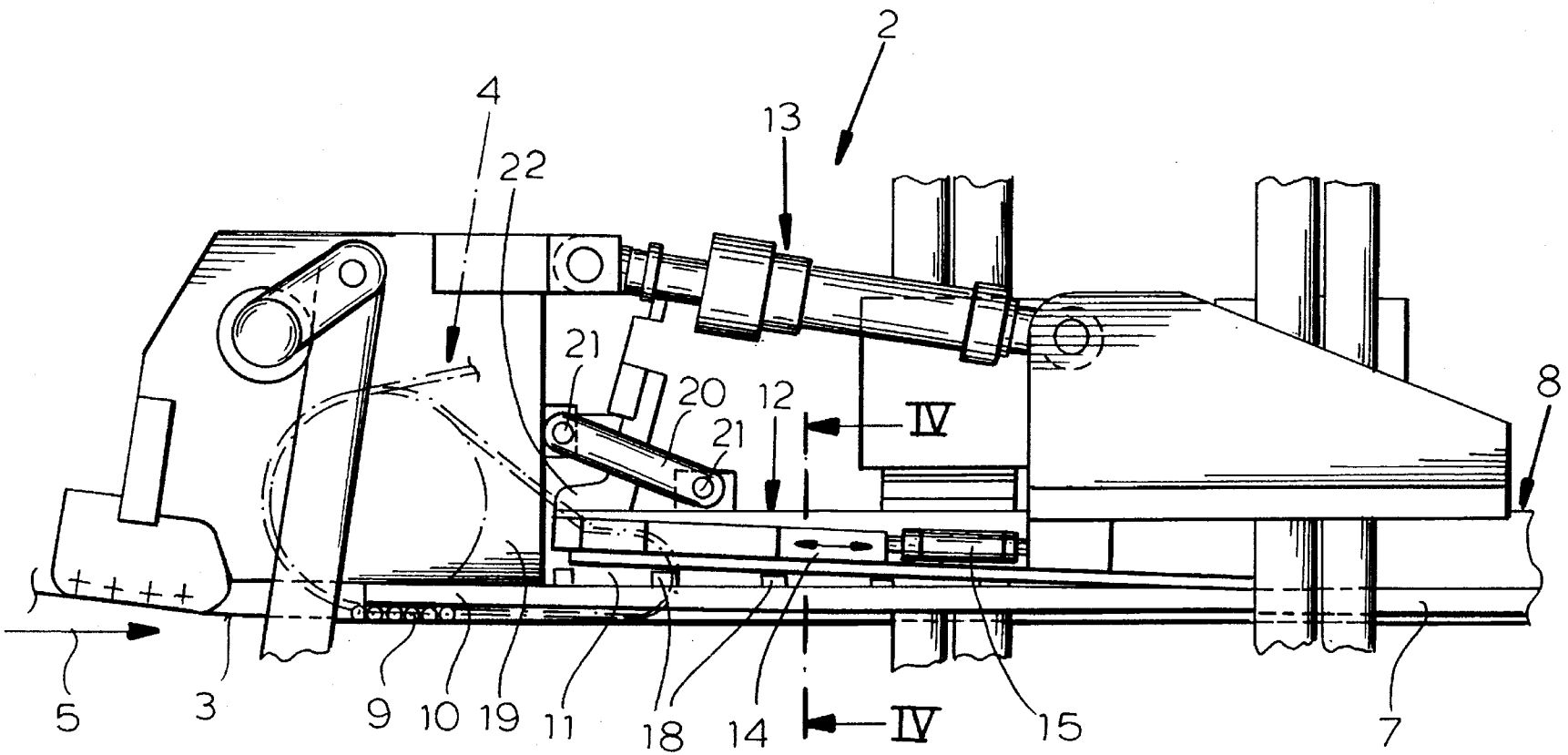
FIG. 2 is a detail enlarged relative to FIG. 1, of the upper portion of the mouth of the press showing features not fully visible in FIG. 1.
Figure 3:
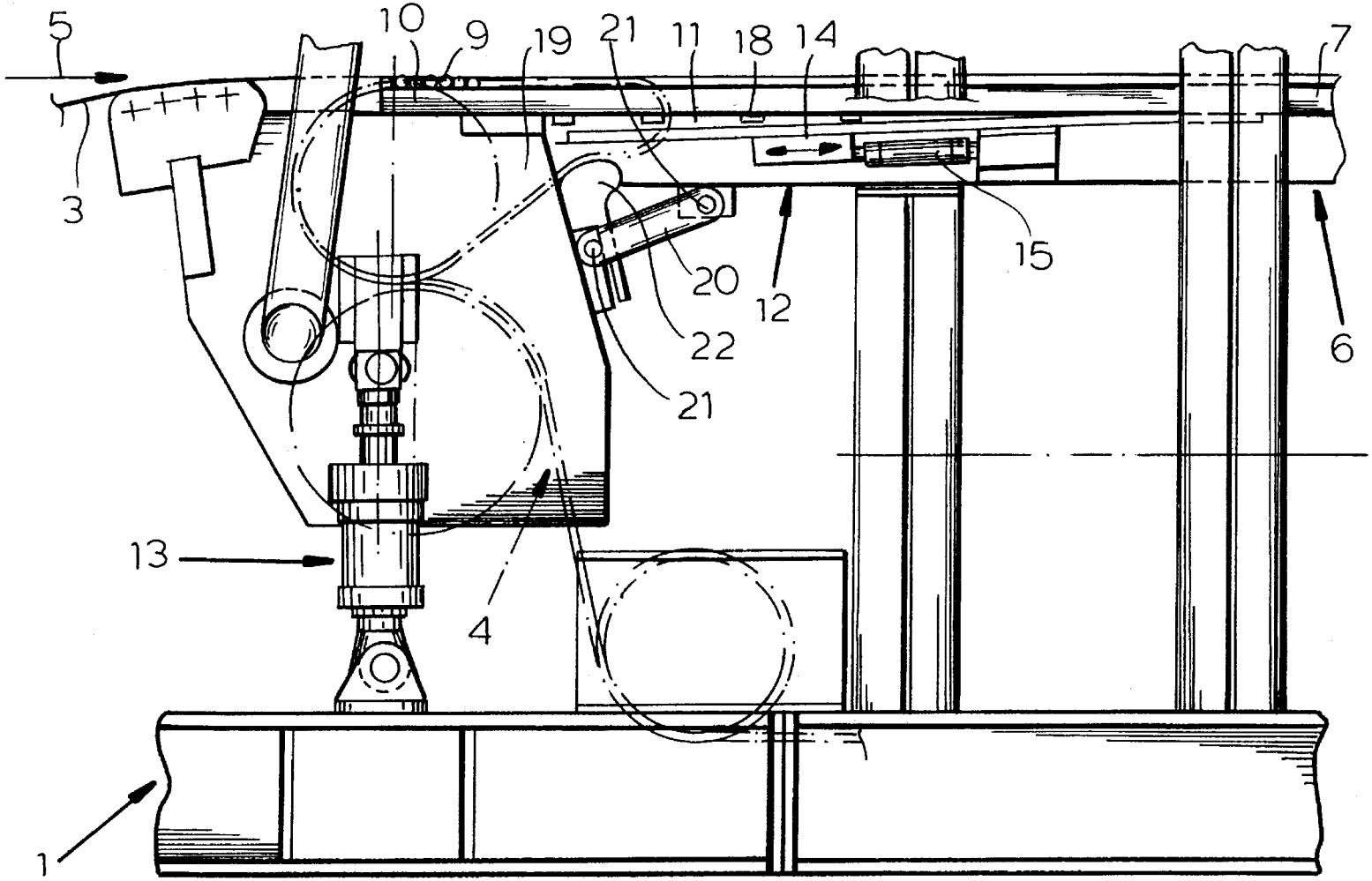
FIG. 3 is a view similar to FIG. 2 of the lower portion of the mouth of the press.

As FIGS. 2 and 3 show, each of the upper and lower platens has an inlet tongue 10 and these inlet tongues largely are equivalent from a mechanical viewpoint. Each of the upper press part 2 and the lower press part 1 can have a respective device 12 for establishing the inlet contour.

Figure 4:
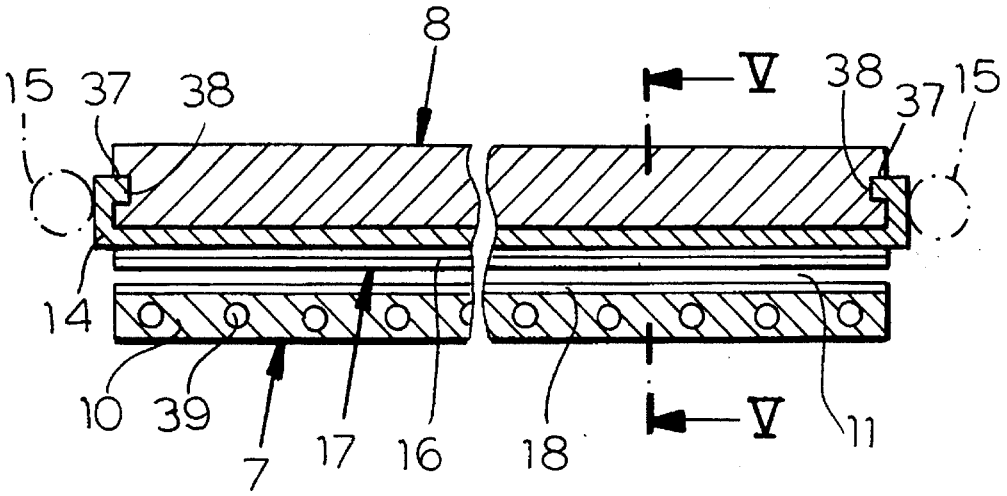
FIG. 4 is a cross section taken along the line IV—IV of FIG. 2.
Figure 5:
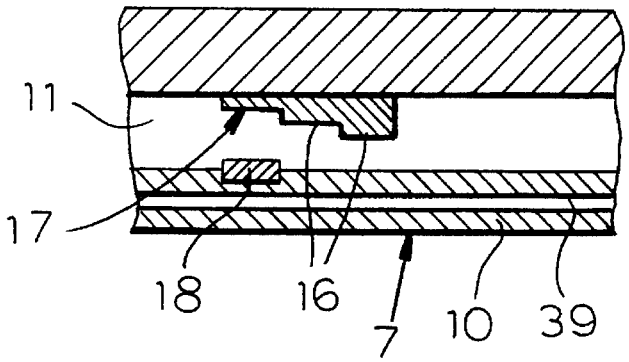
FIG. 5 is a section taken along the line V—V of FIG. 4.

As will be apparent from FIG. 4, the beam 6 or 8, here shown for the beam 8, can have, along its lateral flanks, guide grooves 37 into which inwardly turned flanges 38 of the slider 14 can engage. In FIGS. 4 and 5, the bores 39 are visible, these bores representing the means for heating the platen 7 and being connected to a source of superheated steam or the like.

Figure 6:
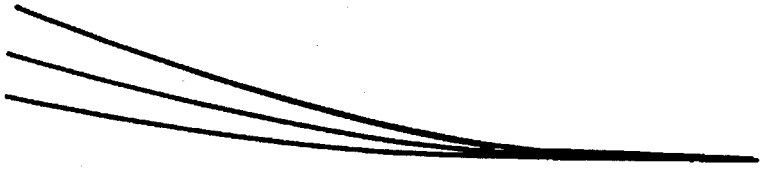
FIG. 6 is a diagram showing various curvatures of the intake tongue at the upper side of the mouth of the press which can be adjusted with precision utilizing the features of the present invention.
Figure 7:
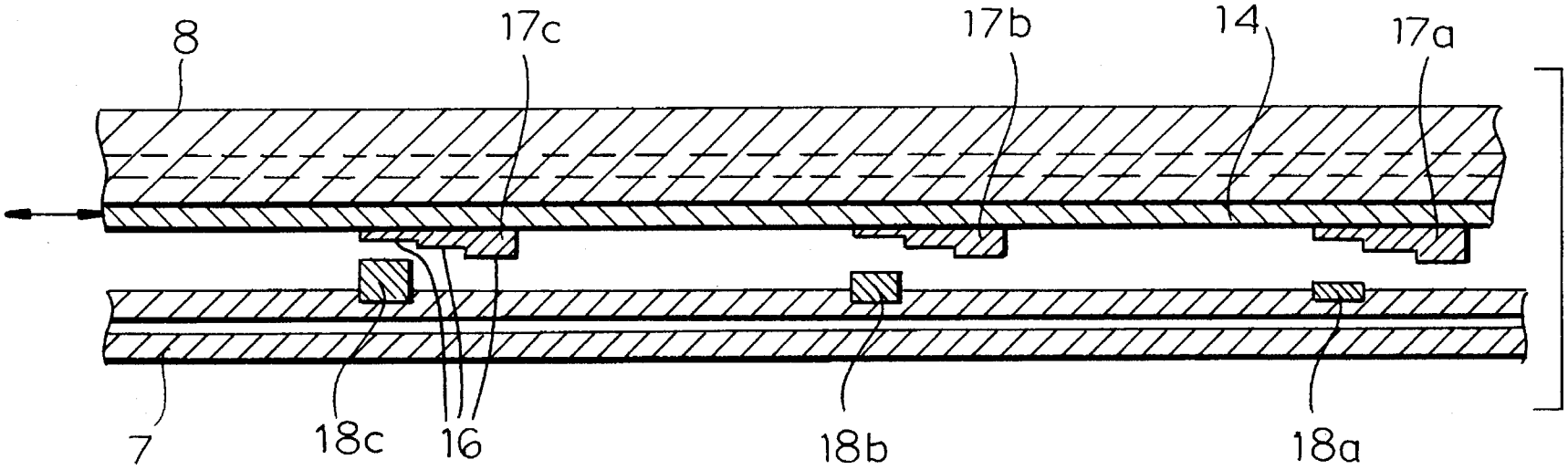
FIG. 7 is a diagram similar to FIG. 5 showing a slider provided with a plurality of abutment staircases according to the invention.

From FIGS. 2 and 3 it will be apparent that a number of counter bars 18 can be provided along the cantilever tongue of the press platen 7 and in that case, is clear from FIG. 7, each of the counter bars 18*a*–18*c*, of a height which is selected to determine the bend counter (FIG. 6), can engage a respective step 16 of the respective staircase 17*a*–17*c* on the slider 14. The greater curvature (FIG. 6) will therefore correspond to engagement of the counter bars with the lowest height step whereas the lesser curvature will correspond to engagement of the counter bars with the highest step in accordance with the displacement of the slider.

We claim:

1. A continuous press for the production of pressed board from a mat of comminuted material, said press comprising:

a press stand;

upper and lower beams mounted in said stand;

upper and lower heated press platens spaced apart between said upper and lower beams on said stand;

upper and lower endless steel belts mounted on said stand, having passes traveling between said press platens and defining an inlet mouth at an inlet side of the press;

respective endless bracing roller devices interposed between each of said passes and the respective press platen to brace the respective pass of the respective belt against the respective press platen;

at least one cantilever tongue projecting on a respective one of said press platens toward said inlet side of the press and defining a gap with the respective one of said beams;

means for setting a contour of said mouth and including means for imparting a bending moment to said tongue; and means for fixing a configuration of said tongue and including:

a contouring slider guided on said one of said beams, a contouring drive operatively connected with said contouring slider for moving said contouring slider back and forth along said one of said beams, a plurality of steps on said slider extending transverse to a direction of feed through said press and disposed in a stop-defining staircase, and a counter bar selectively engageable by said steps in accordance with displacement of said slider, said counter bar being provided on the respective press platen and, by engagement with a selected step of said staircase, determining said configuration of said tongue.

2. The continuous press defined in claim 1 wherein said contouring drive is a piston-and-cylinder arrangement.

3. The continuous press defined in claim 1 wherein said tongue is provided at an inlet end thereof with a lever member fixed to said tongue and a link connected by a horizontal pivot to said lever member and by another horizontal pivot to the respective beam, said means for imparting a bending moment to said tongue including a drive engageable with said lever member.

4. The continuous press defined in claim 3 wherein said drive connected with said lever member is a piston-and-cylinder arrangement.

5. The continuous press defined in claim 1, further comprising an aligning device at said inlet side of said press for aligning rollers of one of said roller devices, said tongue and said slider extending into a region of said aligning device.

6. The continuous press defined in claim 1 wherein a respective said tongue and means for fixing a configuration thereof is provided on each of said upper and lower beams.

* * * * *